US011295691B2

(12) United States Patent
Zhang

(10) Patent No.: US 11,295,691 B2
(45) Date of Patent: Apr. 5, 2022

(54) CURRENT LIMITING CIRCUIT AND DISPLAY DEVICE

(71) Applicant: HKC CORPORATION LIMITED, Shenzhen (CN)

(72) Inventor: Liang Zhang, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/257,978

(22) PCT Filed: Jan. 10, 2019

(86) PCT No.: PCT/CN2019/071074
§ 371 (c)(1),
(2) Date: Jan. 5, 2021

(87) PCT Pub. No.: WO2020/133579
PCT Pub. Date: Jul. 2, 2020

(65) Prior Publication Data

US 2021/0225309 A1 Jul. 22, 2021

(30) Foreign Application Priority Data

Dec. 27, 2018 (CN) ..... 201811610767.0

(51) Int. Cl.
*G09G 3/36* (2006.01)
*G09G 3/20* (2006.01)

(52) U.S. Cl.
CPC ..... *G09G 3/3677* (2013.01); *G09G 3/2096* (2013.01); *G09G 2330/025* (2013.01); *G09G 2330/04* (2013.01)

(58) Field of Classification Search
CPC .. G09G 3/2092; G09G 3/2096; G09G 3/3677; G09G 2330/025; G09G 2330/04
See application file for complete search history.

(56) References Cited

U.S. PATENT DOCUMENTS 6,198,261 B1 * 3/2001 Schultz ..... H02M 3/157 323/272
7,863,865 B2 * 1/2011 Hussain ..... H02J 7/00711 320/140

(Continued)

FOREIGN PATENT DOCUMENTS

CN 102333403 A 1/2012
CN 104700811 A 6/2015

(Continued)

OTHER PUBLICATIONS

Author uncertain, Simple Current Limit Protection Circuit Diagram (Detailed Explanation of Six Simple Current—limiting Protection Circuit Design Schematics), http://www.elecfans.com/dianlutu/protect/20180301641470_a.html, Mar. 1, 2018.

(Continued)

*Primary Examiner* — Gene W Lee
(74) *Attorney, Agent, or Firm* — Westbridge IP LLC

(57) ABSTRACT

A current limiting circuit, comprising a switching circuit and a voltage stabilizing circuit. The switching circuit is separately connected to a voltage input terminal VIN and a voltage output terminal VOUT, and used for transmitting an input voltage to the voltage output terminal VOUT from the voltage input terminal VIN; and the voltage stabilizing circuit is separately connected to the switching circuit, the voltage input terminal VIN, and the voltage output terminal VOUT, used for controlling an output current to reduce together with the switching circuit when the output current of the voltage output terminal VOUT is increased and the output current is less than a preset output current, and further used for controlling the output current to be zero together with the switching circuit when the output current of the voltage output terminal VOUT is greater than or equal to the preset output current.

20 Claims, 2 Drawing Sheets

(56) References Cited

U.S. PATENT DOCUMENTS

| | | | | |
|---|---|---|---|---|
| 8,693,155 | B2 * | 4/2014 | Mizui | G05F 1/573 361/93.7 |
| 8,694,817 | B2 * | 4/2014 | Hoffknecht | H04L 12/40045 713/340 |
| 8,841,897 | B2 * | 9/2014 | Williams | G05F 1/5735 323/285 |
| 2004/0027753 | A1 | 2/2004 | Friedrichs et al. | |
| 2009/0180231 | A1 * | 7/2009 | Tanaka | G05F 1/573 361/93.9 |

FOREIGN PATENT DOCUMENTS

| | | | |
|---|---|---|---|
| CN | 107369425 | A | 11/2017 |
| CN | 207765146 | U | 8/2018 |
| CN | 108767810 | A | 11/2018 |
| CN | 109064985 | A | 12/2018 |

OTHER PUBLICATIONS

First Office Action in counterpart Chinese Patent Application 201811610767.0, dated Dec. 16, 2019.

International Search Report and Written Opinion in corresponding PCT Application No. PCT/CN2019/071074, dated Det. 9, 2019.

Second Office Action in counterpart Chinese Patent Application 201811610767.0, dated Jun. 29, 2020.

Third Office Action in counterpart Chinese Patent Application 201811610767.0, dated Dec. 3, 2020.

Zhang, Transistorized DC Regulated Power Supply, pp. 85-87, Dec. 31, 1982, Liaoning Science and Technology Press, Shenyang, China.

* cited by examiner

CURRENT LIMITING CIRCUIT AND DISPLAY DEVICE

CROSS REFERENCES TO RELATED APPLICATIONS

The present disclosure is the National Stage of International Application No. PCT/CN2019/071074, filed Jan. 10, 2019, which claims priority to Chinese patent application No. 2018116107670, entitled "CURRENT LIMITING CIRCUIT AND DISPLAY DEVICE" filed on Dec. 27, 2018, which is incorporated herein as a reference in its entirety.

FIELD

The disclosure relates to the technical field of display, in particular to a current limiting circuit and a display device

BACKGROUND

The statements herein merely provide background information related to the present disclosure and do not necessarily constitute prior art.

As people have increasingly strong demand for narrow-frame televisions, the liquid crystal display panels with GDL (Gate Driver Less and No Gate Drive) are increasingly popular. The GDL circuit is composed of two parts of a level shifter IC (boosting integrated circuit) and a shift register (shift register). The level shifter IC is arranged on the driving plate, the shift register is arranged on the liquid crystal display panel, and the level shifter IC transmits a CLK (Clock) signal to the shift register to complete the driving of the liquid crystal display panel. The level shifter IC is arranged on the driving panel so that the frame length of the liquid crystal display panel can be reduced.

The existing GDL circuit normally protects the display panel by setting a preset output current in the level shifter IC, but this protection mode can easily cause false shutdown of the display panel if the preset output current is set too small; and if the preset output current is set too large, the excessive output current can cause damage to the glasses of the liquid crystal display panel.

SUMMARY

According to various embodiments of the present disclosure, a current-limiting circuit and a display device are provided.

A current limiting circuit includes:

a switching circuit, respectively connected with a voltage input terminal and a voltage output terminal and for transmitting an input voltage from the voltage input terminal to the voltage output terminal; and a voltage stabilizing circuit, respectively connected with the switching circuit, the voltage input terminal and the voltage output terminal, and for controlling an output current to be reduced when the output current of the voltage output terminal is increased and the output current is less than a preset output current; and further for controlling the output current to be zero when the output current of the voltage output terminal is not less than the preset output current.

In one embodiment, the switching circuit includes a first switching circuit, the first switching circuit is connected with the voltage stabilizing circuit, the voltage input terminal and the voltage output terminal, and cooperating with the voltage stabilizing circuit to control the output current to be reduced when the output current of the voltage output terminal is increased and the output current is less than the preset output current, and control the output current to be zero when the output current of the voltage output terminal is not less that the preset output current.

In one embodiment, the switching circuit includes a second switching circuit, the second switching circuit is connected with the first switching circuit, the voltage stabilizing circuit, the voltage input terminal and the voltage output terminal, the voltage stabilizing circuit and the first switching circuit are further for controlling the second switching circuit to be conducted when the output current of the voltage output terminal is increased and the output current is less than the preset output current; the voltage stabilizing circuit and the first switching circuit are further for controlling the second switching circuit to be turned off when the output current of the voltage output terminal is not less than the preset output current.

In one embodiment, the voltage stabilizing circuit includes a voltage stabilizing tube and a first resistor, a first terminal of the voltage stabilizing tube is connected with the voltage output terminal, a second terminal of the voltage stabilizing tube is respectively connected with a first terminal of the first resistor, the first switching circuit and the second switching circuit, a second terminal of the first resistor is connected with the voltage input terminal.

In one embodiment, the voltage stabilizing tube is a voltage stabilizing diode, the first terminal and the second terminal of the voltage stabilizing diode are respectively corresponding to a positive electrode and a negative electrode of the voltage stabilizing diode.

In one embodiment, the first switching circuit includes a first electronic switch, a second resistor and a third resistor, a first terminal of the first electronic switch is connected with the second terminal of the voltage stabilizing tube, a second terminal of the first electronic switch is connected with the voltage output terminal through the second resistor, a third terminal of the first electronic switch is connected with the voltage input terminal through the third resistor, the third terminal of the first electronic switch is further connected with the second switching circuit.

The current limiting circuit of claim 6, wherein the second switching circuit includes a second electronic switch and a fourth resistor, a first terminal of the second electronic switch is connected with the third terminal of the first electronic switch, a second terminal of the second electronic switch is connected with the voltage input terminal, a third terminal of the second electronic switch is connected with the voltage output terminal through the fourth resistor, and the third terminal is further connected with the second terminal of the voltage stabilizing tube.

In one embodiment, the first electronic switch is an N-channel field effect transistor, the first terminal, the second terminal and the third terminal of the first electronic switch are respectively corresponding to a grid, a source and a drain of the N-channel field effect transistor.

In one embodiment, the first electronic switch is an NPN type triode, the first terminal, the second terminal and the third terminal of the first electronic switch are respectively corresponding to a base, an emitter and a collector of the NPN type triode.

In one embodiment, the second electronic switch is a P-channel field effect tube, the first terminal, the second terminal and the third terminal of the second electronic switch are respectively corresponding to a grid, a source and a drain of the P-channel field effect tube.

In one embodiment, the second electronic switch is a PNP type triode, the first terminal, second terminal and third terminal of the second electronic switch are respectively corresponding to a base, an emitter and a collector of the PNP type triode.

A current limiting circuit includes:

a switching circuit, respectively connected with a voltage input terminal and a voltage output terminal and are for transmitting an input voltage from the voltage input terminal to the voltage output terminal; and a voltage stabilizing circuit, respectively connected with the switching circuit, the voltage input terminal and the voltage output terminal, and for controlling the output current to be reduced when the output current of the voltage output terminal is increased and the output current is less than a preset output current; and further for controlling the output current to be zero when the output current of the voltage output terminal is not less than the preset output current.

the switching circuit includes:

a first switching circuit respectively connected with the voltage stabilizing circuit, the voltage input terminal and the voltage output terminal, and for cooperating with the voltage stabilizing circuit to control the output current to be reduced when the output current of the voltage output terminal is increased and the output current is less than a preset output current, and further for cooperating with the voltage stabilizing circuit to control the output current to be zero when the output current of the voltage output terminal is not less than the preset output current; and a second switching circuit respectively connected with the first switching circuit, the voltage stabilizing circuit, the voltage input terminal and the voltage output terminal;

the voltage stabilizing circuit and the first switching circuit are for controlling the second switching circuit to be conducted when an output current of the voltage output terminal is increased and the output current is less than the preset output current; the voltage stabilizing circuit and the first switching circuit are further for controlling the second switching circuit to be turned off when the output current of the voltage output terminal is not less than the preset output current.

A display device includes a power supply integrated circuit, a boosting integrated circuit, a drive circuit panel, a display panel, a shifting register and the above current limiting circuit; the current limiting circuit is connected between the power supply integrated circuit and the boosting integrated circuit; the power supply integrated circuit, the boosting integrated circuit and the current limiting circuit are all arranged on the drive circuit panel, and the shifting register is arranged across the display panel.

In one embodiment, a signal that is transferred by the current limiting circuit to the boosting integrated circuit is a low-potential signal, and the boosting integrated circuit is for converting the low-potential signal into a high-potential signal.

In one embodiment, an absolute value of the low-potential signal is less than an absolute value of the high-potential signal.

In one embodiment, the low-potential signal is a digital signal, and the high-potential signal is an analog signal.

In one embodiment, the display panel is a liquid crystal display panel.

In one embodiment, the display panel includes an active array substrate, a color filter substrate and a liquid crystal layer between the two substrates.

In one embodiment, the shifting register is arranged on the active array substrate.

In one embodiment, the display panel is a curved display panel.

The details of one or more embodiments of the present disclosure are set forth in the accompanying drawings and the description below. Other features, objects, and advantages of the present disclosure will become apparent from the description, the drawings, and the claims.

DETAILED DRAWINGS OF THE EMBODIMENTS

In order to more clearly illustrate the technical solutions of the embodiments of the present disclosure or the related art, the accompanying drawings, which are used in the description of the embodiments or the related art, are briefly described. It will be apparent that the drawings in the following description are merely some embodiments of the present disclosure, and for a person of ordinary skill in the art, the figures of other embodiments may also be obtained according to these drawings.

DETAILED DESCRIPTIONS OF THE EMBODIMENTS

Figure 1:
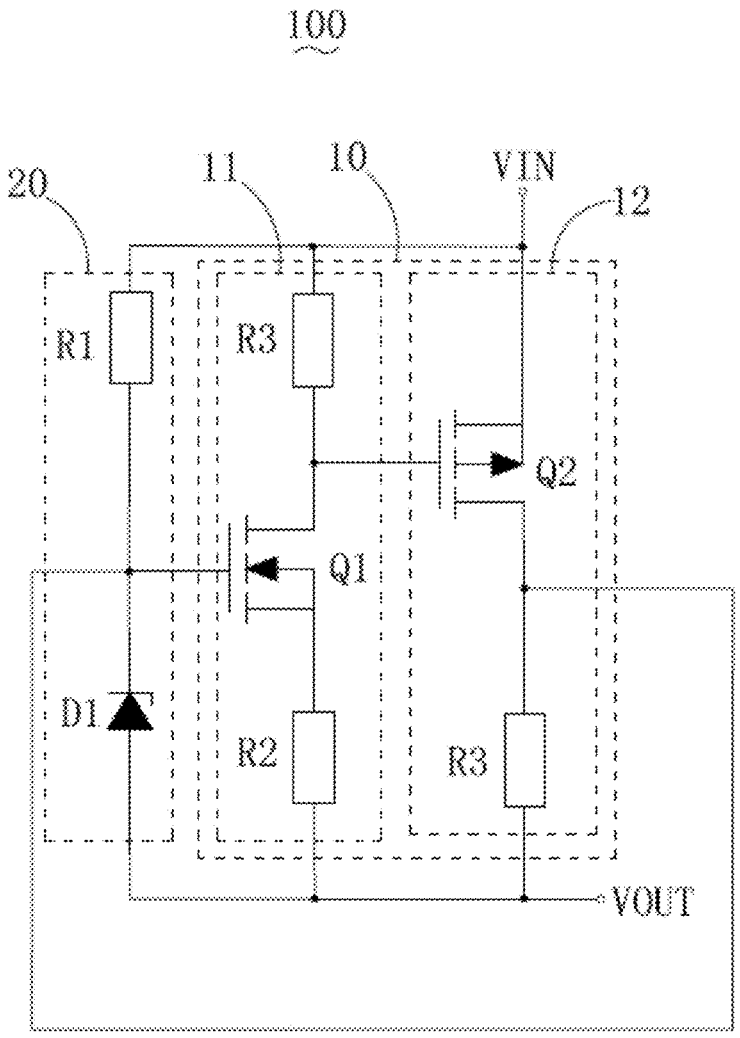
FIG. 1 is a circuit diagram of a current limiting circuit according to one embodiment.

For easier understanding of the present disclosure, the present disclosure will be described more fully hereinafter with reference to the associated drawings. Exemplary embodiments of the present disclosure are given in the drawings. This disclosure may, however, be embodied in many different forms and is not limited to the embodiments described herein. In contrast, the purpose of providing these embodiments is to provide a more comprehensive understanding of the disclosure of the present disclosure.

Unless otherwise defined, all technical and scientific terms used herein have the same meaning as commonly understood by one of ordinary skill in the art to which this disclosure belongs. The terminology used herein is for the purpose of describing particular embodiments only and is not intended to be limitation of the present disclosure. As used herein, the term "and/or" includes any and all combinations of one or more of the associated listed items.

It should be noted that when an element is considered to be "connected" to another element, it may be directly connected to another element or intervening elements may be present at the same time.

Detailed description of the preferred embodiments of the present disclosure is provided below.

Referring to FIG. 1, which is a circuit diagram of a current limiting circuit 100 provided by the present disclosure. The current limiting circuit 100 includes a switching circuit 10 and a voltage stabilizing circuit 20. The switching circuit 10 is respectively connected with a voltage input terminal VIN and a voltage output terminal VOUT and is for transmitting an input voltage from the voltage input terminal VIN to the voltage output terminal VOUT. The voltage stabilizing circuit 20 is connected with the switching circuit 10, the voltage input terminal VIN and the voltage output terminal VOUT, and is for cooperating with the switching circuit 10, to control an output current to be reduced when the output current of the voltage output terminal VOUT is increased and the output current is less than a preset output current, and to control the output current to be zero when the output current of the voltage output terminal VOUT is greater than or equal to the preset output current.

Figure 2:
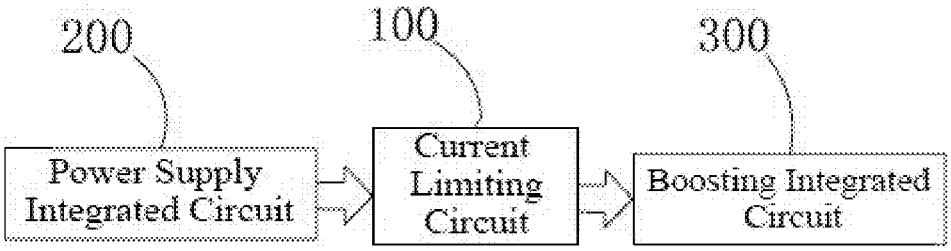
FIG. 2 is a schematic block diagram of a display device according to one embodiment.

Referring to FIG. 2, the current limiting circuit 100 is connected between a power supply integrated circuit 200 and a boosting integrated circuit 300. Specifically, the voltage input terminal VIN of the current limiting circuit 100 is connected with the power supply integrated circuit 200, and the voltage output terminal VOUT of the current limiting circuit 100 is connected with the boosting integrated circuit 300. The current limiting circuit 100, the power supply integrated circuit 200, and the boosting integrated circuit 300 are applied to a display device. System main board power supply is transmitted to the shift register after being processed by the power supply integrated circuit 200, the current limiting circuit 100 and the boosting integrated circuit 300, and the display of the display panel is driven through the shifting register. The current limiting circuit 100 limits a current driving the liquid crystal display panel to prevent the liquid crystal display panel from being damaged due to excessive driving current.

It should be noted that when the output current of the voltage output terminal VOUT is increased and the output current is less than the preset output current, the switching circuit 10 is conducted, and the power supply integrated circuit 200 can transmit power to the voltage output terminal VOUT of the boosting integrated circuit 300 through the current limiting circuit 100. An output current of the voltage output terminal VOUT is zero, namely the switching circuit 10 is turned off, and a path between the power supply integrated circuit 200 and the boosting integrated circuit 300 is disconnected.

The switching circuit 10 includes a first switching circuit 11, where the first switching circuit 11 is respectively connected with the voltage stabilizing circuit 20, the voltage input terminal VIN and the voltage output terminal VOUT. The first switching circuit 11 is for cooperating with the voltage stabilizing circuit 20, to control the output current to be reduced when the output current of the voltage output terminal VOUT is increased and the output current is less than the preset output current. At this time, the voltage output terminal VOUT still has current output and can inhibit the increase of the output current, so that the phenomenon that the protection current of the liquid crystal display panel set in the boost integrated circuit 300 is too small and the liquid crystal display panel is easily triggered to shut down is avoided. The first switching circuit 11 is also for cooperating with the voltage stabilizing circuit 20, to control the output current to be zero when the output current of the voltage output terminal VOUT is greater than or equal to the preset output current. When the output current of the voltage output terminal VOUT is greater than or equal to a preset output current, the switching circuit 10 is turned off, so that the situation that the output current of the voltage output terminal VOUT is too large to damage the liquid crystal display panel is avoided.

The switching circuit 10 further includes a second switching circuit 12, wherein the second switching circuit 12 is respectively connected with the first switching circuit 11, the voltage stabilizing circuit 20, the voltage input terminal VIN and the voltage output terminal VOUT. The voltage stabilizing circuit 20 and the first switching circuit 11 are also for controlling the second switching circuit 12 to be conducted when the output current of the voltage output terminal VOUT is increased and the output current is less than the preset output current. The voltage stabilizing circuit 20 and the first switching circuit 11 are also for controlling the second switching circuit 12 to be turned off when the output current of the voltage output terminal VOUT is greater than or equal to the preset output current. The second switching circuit 12 and the first switching circuit 11 realize the conduction of the voltage input terminal VIN and the voltage output terminal VOUT when the output current of the voltage output terminal VOUT is less than a preset output current, and limit the increase of the output current.

The voltage stabilizing circuit 20 includes a voltage stabilizing tube D and a first resistor R1, a first terminal of the voltage stabilizing tube D1 is connected with the voltage output terminal VOUT, a second terminal of the voltage stabilizing tube D1 is connected with a first terminal of the first resistor R1, the first switching circuit 11 and the second switching circuit 12, and a second terminal of the first resistor R1 is connected with the voltage input terminal VIN. The voltage stabilizing tube D1 is for maintaining a voltage of the second terminal of the voltage stabilizing tube D1 to be a stabilizing voltage when the voltage of the second terminal of the voltage stabilizing tube D1 is greater than the stabilizing voltage of the voltage stabilizing tube D1.

In one embodiment, the voltage stabilizing tube D1 is a voltage stabilizing diode.

The first switching circuit 11 includes a first electronic switch Q1, a second resistor R2 and a third resistor R3, a first terminal of the first electronic switch Q1 is connected with the second terminal of the voltage stabilizing tube D1. A second terminal of the first electronic switch Q1 is connected with the voltage output terminal VOUT through the second resistor R2, a third terminal of the first electronic switch Q1 is connected with the voltage input terminal VIN through the third resistor R3, and the third terminal of the first electronic switch Q1 is further connected with the second switching circuit 12.

The second switching circuit 12 includes a second electronic switch Q2 and a fourth resistor R4, a first terminal of the second electronic switch Q2 is connected with the third terminal of the first electronic switch Q1. A second terminal of the second electronic switch Q2 is connected with the voltage input terminal Vin, a third terminal of the second electronic switch Q2 is connected with the voltage output terminal VOUT through the fourth resistor R4, and the third terminal of the second electronic switch Q2 is also connected with the second terminal of the voltage stabilizing tube D1.

In one embodiment, the first electronic switch Q1 is an NMOS transistor or an NPN type triode, and the first terminal, the second terminal and the third terminal of the first electronic switch Q1 are corresponding to a grid, a source and a drain of the NMOS transistor or a base, an emitting and a collector of the NPN type triode. In other embodiments, the first electronic switch Q1 may be other switches having the same or similar functions, such as insulated gate bipolar transistors. The first electronic switch Q1 adopting an NMOS transistor or an NPN type triode is small in loss, quick in response, stable and reliable.

In one embodiment, the second electronic switch Q2 is a PMOS transistor or a PNP type triode, the first terminal, second terminal and third terminal of the second electronic switch Q2 are respectively corresponding to a grid, a source and a drain of the PMOS transistor or a base, an emitter and a collector of the PNP type triode. In other embodiments, the first electronic switch Q1 may be other switches having the same or similar functions, such as an insulated grid bipolar transistor. The second electronic switch Q2 adopts a PMOS transistor or a PNP type triode, which is small in loss, quick in response, stable and reliable.

The working principle of the current limiting circuit 100 is illustrated by taking the first electronic switch Q1 to be an NMOS transistor and the second electronic switch Q2 to be a PMOS transistors.

The input voltage of the voltage input terminal VIN is Vin, the stabilizing voltage of the voltage stabilizing tube D1 is V1, the output voltage of the voltage output terminal VOUT is Vout, a voltage across a grid and a source of the NMOS transistor is VGS 1, a voltage across the grid and the source of the PMOS transistor is VGS2, and a voltage across the second resistor R2 is VR2. When the output current of the voltage output terminal VOUT increases and the output current of the voltage output terminal VOUT is less than the preset output current, the voltage VR2 across the second resistor R2 increases, for V1=VGS1+VR2, VGS1=V1−VR2 and VGS reduces. According to the characteristics of a MOS transistor, I=g*VGS1 (g is a fix parameter of the MOS transistor), I is a current flowing through the NMOS transistor. With decreasing of the current I in the NMOS transistor, the output voltage of the voltage output terminal VOUT is decreased. But meanwhile, the NMOS transistor and the PMOS transistor are both conducted, which inhibits the increase of the output current and meanwhile does not affects the driving of the LCD display panel. When the output current of the voltage output terminal VOUT is not less than the preset output current, VGS15 V1−VR2, the NMOS transistor is turned off, a grid voltage of the PMOS transistor is Vin, and the voltage across the grid and the source of the PMOS transistor VGS2=Vin−Vin=0. Thus, the PMOS is cut off, and the voltage across the gate and the source of the NMOS transistor VGS=Vout−Vout=0, the NMOS transistor maintains a cut-off state, and the output current of the voltage output terminal VOUT is 0, thereby preventing the output current of the voltage output terminal VOUT from being too large to damage the liquid crystal display panel.

After the fault which causes the output current of the voltage output terminal VOUT to be greater than or equal to the preset output current is removed, the power integrated circuit 200 is powered on again, the stabilizing voltage of the voltage stabilizing tube D1 is maintained as V1, the NMOS tube is turned on, and then the PMOS tube is turned on, and the current limiting circuit 100 works normally.

Figure 3:
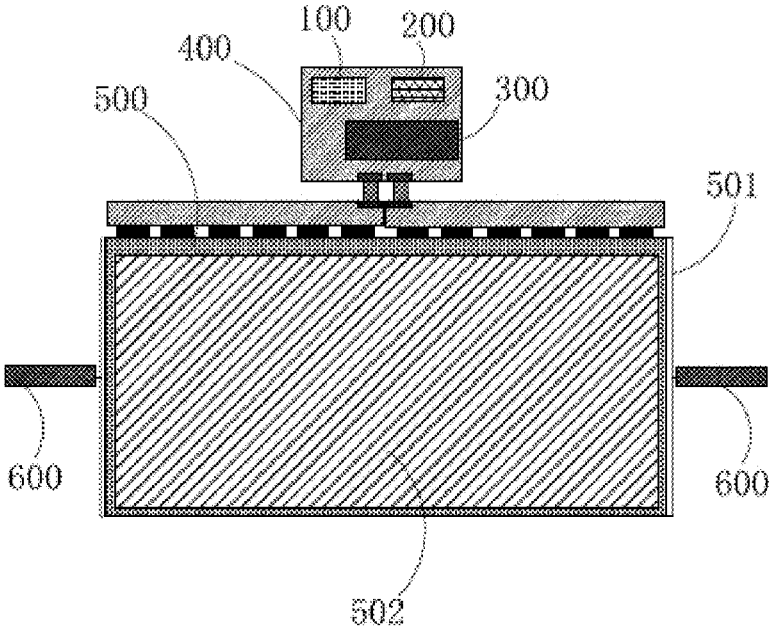
FIG. 3 is a schematic block diagram of a display device according to another embodiment.

Referring to FIG. 3, the present disclosure also provides a display device including a current limiting circuit 100, a power supply integrated circuit 200, a boosting integrated circuit 300, a driving circuit board 400, a display panel 500, and a shifting register 600.

The current limiting circuit 100 and the power supply integrated circuit 200 are both arranged on the driving circuit board 400.

The current limiting circuit 100 transmits a signal which is a low-potential signal to the boosting integrated circuit 300, and the boosting integrated circuit 300 is for converting the low-potential signal into a high-potential signal.

A potential absolute value of the low-potential signal is smaller than a potential absolute value of the high-potential signal.

The low-potential signal is a digital signal, and the high-potential signal is an analog signal.

The GDL circuit includes the boosting integrated circuit 300 and the shifting register 600. The boosting integrated circuit 300 is arranged on the driving circuit board 400. The shifting register 600 is arranged across the display panel 500. Since the area occupied by the shifting register 600 is small, the display panel of the GDL architecture can achieve a narrower frame.

The display panel 500 includes an active array (thin film transistor, TFT) substrate 501, a color filter (CF) substrate 502 and a liquid crystal layer (not shown) formed between the two substrates. The shifting register 600 is disposed on the active array substrate 501. The shifting register 600 is arranged on the active array substrate 501.

In one embodiment, the display panel 500 is a curved display panel.

In other embodiments, the display panel 500 may be any of a liquid crystal display panel, an OLED display panel, a QLED display panel, a twisted nematic (TN) or super twisted nematic (STN) type, an in-plane switching (IPS) type, a vertical alignment (VA) type, or other display panel.

In one embodiment, the active array and the color filter layer can be formed on the same substrate.

According to the current limiting circuit and the display device, when an output current of the voltage output terminal is greater than or equal to a preset output current, a voltage stabilizing circuit and a switching circuit can control the output current to be zero, and the situation that the output current is too large to damage the liquid crystal display panel can be avoided. When the current output by the voltage output terminal is increased and the output current is less than the preset output current, the voltage stabilizing circuit and the switching circuit can control the output current to be reduced, so that the output current can be limited when the output current is increased in a range defined by the preset output current; therefore, the preset output current can be set to be larger and the display panel is not prone to have a false shot down.

The technical features of the embodiments described above can be combined in any combination, to make the description concise, not all possible combinations of the technical features in the above embodiments are described. However, as long as the combinations of the technical features does not conflict, it is to be considered the combinations fall within the scope of the present specification.

The embodiments described above only relate to several embodiments of the present disclosure, which are described in more detail, but are not therefore to be construed as limiting the scope of the disclosure. It should be noted that several variations and modifications can be made to one of ordinary skill in the a without departing from the concepts of the present disclosure, all of which fall within the scope of the present disclosure. Therefore, the scope of protection of the patent disclosure should depend on the appended claims.

What is claimed is:

1. A current limiting circuit, comprising:

a switching circuit respectively connected with a voltage input terminal and a voltage output terminal, and for transmitting an input voltage from the voltage input terminal to the voltage output terminal; and a voltage stabilizing circuit respectively connected with the switching circuit, the voltage input terminal and the voltage output terminal, and for cooperating with the switching circuit to control an output current to be reduced, when the output current of the voltage output terminal is increased and the output current is less than a preset output current;

wherein, the voltage stabilizing circuit is further for cooperating with the switching circuit to control the output current to be zero when the output current of the voltage output terminal is not less than the preset output current.

2. The current limiting circuit of claim 1, wherein the switching circuit comprises:

a first switching circuit connected with the voltage stabilizing circuit, the voltage input terminal and the voltage output terminal;

wherein, the first switching circuit is for cooperating with the voltage stabilizing circuit to control the output current to be reduced, when the output current of the voltage output terminal is increased and the output current is less than the preset output current; and the first switching circuit is further for cooperating with the voltage stabilizing circuit to control the output current to be zero, when the output current of the voltage output terminal is not less that the preset output current.

3. The current limiting circuit of claim 2, wherein the switching circuit further comprises:

a second switching circuit respectively connected with the first switching circuit, the voltage stabilizing circuit, the voltage input terminal and the voltage output terminal;

wherein, the voltage stabilizing circuit and the first switching circuit are further for controlling the second switching circuit to be conducted when the output current of the voltage output terminal increased and the output current is less than the preset output current; and the voltage stabilizing circuit and the first switching circuit are further for controlling the second switching circuit to be turned off when the output current of the voltage output terminal is not less than the preset output current.

4. The current limiting circuit of claim 3, wherein the voltage stabilizing circuit comprises:

a voltage stabilizing tube;

a first resistor;

wherein, a first terminal of the voltage stabilizing tube is connected with the voltage output terminal; and a second terminal of the voltage stabilizing tube is respectively connected with a first terminal of the first resistor, the first switching circuit and the second switching circuit;

a second terminal of the first resistor is connected with the voltage input terminal.

5. The current limiting circuit of claim 4, wherein the voltage stabilizing tube is a voltage stabilizing diode, the first terminal and the second terminal of the voltage stabilizing tube are respectively corresponding to a positive electrode and a negative electrode of the voltage stabilizing transistor.

6. The current limiting circuit of claim 4, wherein the first switching circuit comprises:

a first electronic switch;

a second resistor; and a third resistor;

wherein, a first terminal of the first electronic switch it the second terminal of the voltage stabilizing tube;

a second terminal of the first electronic switch is connected with the voltage output terminal through the second resistor;

a third terminal of the first electronic switch is connected with the voltage input terminal through the third resistor, and connected with the second switching circuit.

7. The current limiting circuit of claim 6, wherein the second switching circuit comprises:

a second electronic switch; and a fourth resistor;

wherein, a first terminal of the second electronic switch is connected with the third terminal of the first electronic switch;

a second terminal of the second electronic switch is connected with the voltage input terminal;

a third terminal of the second electronic switch is connected with the voltage output terminal through the fourth resistor, and connected with the second terminal of the voltage stabilizing tube.

8. The current limiting circuit of claim 7, wherein the second electronic switch is a P-channel field effect tube, the first terminal, the second terminal and the third terminal of the second electronic switch are respectively corresponding to a grid, a source and a drain of the P-channel field effect tube.

9. The current limiting current of claim 7, wherein the second electronic switch is a PNP type triode, the first terminal, the second terminal and third terminal of the second electronic switch are respectively corresponding to a base, an emitter and a collector of the PNP type triode.

10. The current limiting circuit of claim 6, wherein the first electronic switch is an N-channel field effect transistor, the first terminal, the second terminal and the third terminal of the first electronic switch are respectively corresponding to a grid, a source and a drain of the N-channel field effect transistor.

11. The current limiting circuit of claim 6, wherein the first electronic switch is an NPN type triode, the first terminal, the second terminal and the third terminal of the first electronic switch are respectively corresponding to a base, an emitter and a collector of the NPN type triode.

12. A display device, comprising:

a power supply integrated circuit;

a boosting integrated circuit;

a drive circuit panel;

a display panel;

a shifting register; and the current limiting circuit of claim 1 connected between the power supply integrated circuit and the boosting integrated circuit;

wherein, the power supply integrated circuit, the boosting integrated circuit and the current limiting circuit are all arranged on the drive circuit panel, and the shifting register is arranged across the display panel.

13. The display device of claim 12, wherein a signal that is transferred by the current limiting circuit to the boosting integrated circuit is a low-potential signal, and the boosting integrated circuit is for converting the low-potential signal into a high-potential signal.

14. The display device of claim 13, wherein an absolute value of the low-potential signal is less than an absolute value of the high-potential signal.

15. The display device of claim 13, wherein the low-potential signal is a digital signal, and the high-potential signal is an analog signal.

16. The display device of claim 12, wherein the display panel is a liquid crystal display panel.

17. The display device of claim 16, wherein the display panel comprises an active array substrate, a color filter substrate and a liquid crystal layer between the active array substrate and the color filter substrate.

18. The display device of claim 17, wherein the shifting register is arranged on the active array substrate.

19. The display device of claim 12, wherein the display panel is a curved display panel.

20. A current limiting circuit, comprising:

a switching circuit respectively connected with a voltage input terminal and a voltage output terminal, and for transmitting an input voltage from the voltage input terminal to the voltage output terminal; and a voltage stabilizing circuit respectively connected with the switching circuit, the voltage input terminal and the voltage output terminal, and for controlling an output current to be reduced, when the output current of the voltage output terminal is increased and the output current is less than a preset output current;

wherein, the voltage stabilizing circuit is further for controlling the output current to be zero, when the output current of the voltage output terminal is not less than the preset output current;

the switching circuit comprises:

a first switching circuit respectively connected with the voltage stabilizing circuit, the voltage input terminal and the voltage output terminal, and for cooperating with the voltage stabilizing circuit to control the output current to be reduced, when the output current of the voltage output terminal is increased and the output current is less than a preset output current; and further for cooperating with the voltage stabilizing circuit to control the output current to be zero, when the output current of the voltage output terminal is not less than the preset output current; and a second switching circuit respectively connected with the first switching circuit, the voltage stabilizing circuit, the voltage input terminal and the voltage output terminal;

wherein, the voltage stabilizing circuit and the first switching circuit are for controlling the second switching circuit to be conducted, when the output current of the voltage output terminal is increased and the output current is less than the preset output current;

and further for controlling the second switching circuit to be turned off when the output current of the voltage output terminal is not less than the preset output current.

* * * * *